United States Patent [19]

Kuris

[11] 4,043,084

[45] Aug. 23, 1977

[54] ULTRASONIC PERSPECTIVE CARVING

[76] Inventor: Arthur Kuris, 3725 Henry Hudson Parkway, Riverdale, N.Y. 10463

[21] Appl. No.: 660,412

[22] Filed: Feb. 23, 1976

[51] Int. Cl.[2] ..... B24B 1/00

[52] U.S. Cl. ..... 51/318; 51/59 SS; 51/283 R; 101/32

[58] Field of Search ..... 51/59 SS, 310, 311, 51/312, 318, 326, 327, 283; 101/32; 264/23, 293

[56] References Cited

U.S. PATENT DOCUMENTS

| | | | |
|---|---|---|---|
| 2,748,298 | 5/1956 | Calosi et al. | 51/59 SS X |
| 3,089,411 | 5/1963 | Sollberger et al. | 51/59 SS X |
| 3,328,925 | 7/1967 | Hewitt | 51/312 |
| 3,635,609 | 1/1972 | Balamuth | 264/23 X |

OTHER PUBLICATIONS

Neppiras, "Special Ultrasonic Drilling Techniques", *Metalworking Production,* Oct. 5, 1956, pp. 1599–1604.

*Primary Examiner*—James L. Jones, Jr.
*Assistant Examiner*—K. J. Ramsey

[57] ABSTRACT

Carving of perspective designs in transparent objects with ultrasonic abrasive slurry machining is obtained by using at least two tools each having a different configuration at the working surface and sequentially carving each tool in the object on a surface thereof in partially overlapping relation to each other at different depths. Means are provided wherein the object is sequentially advanced from tool to tool to be multiply carved with each carving being of a different depth than the prior carving to obliterate same and to present to the viewer a perspective carving when viewed from the opposite surface than the surface carved.

49 Claims, 24 Drawing Figures

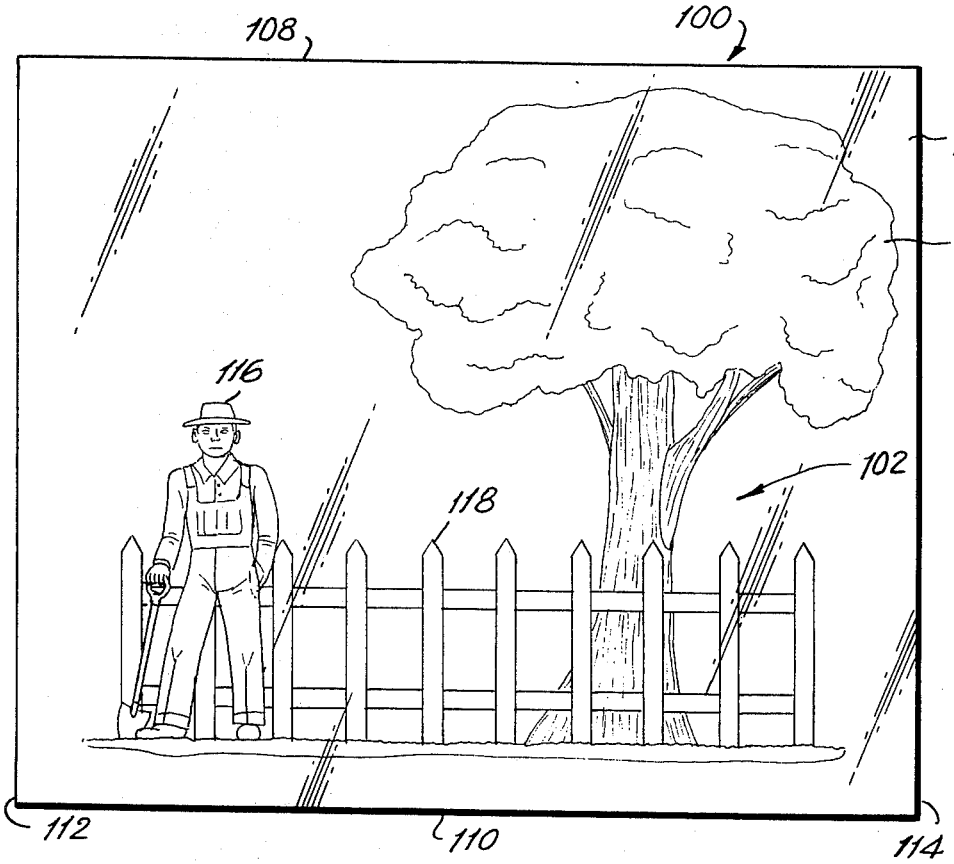
FIG.1
FIG.2
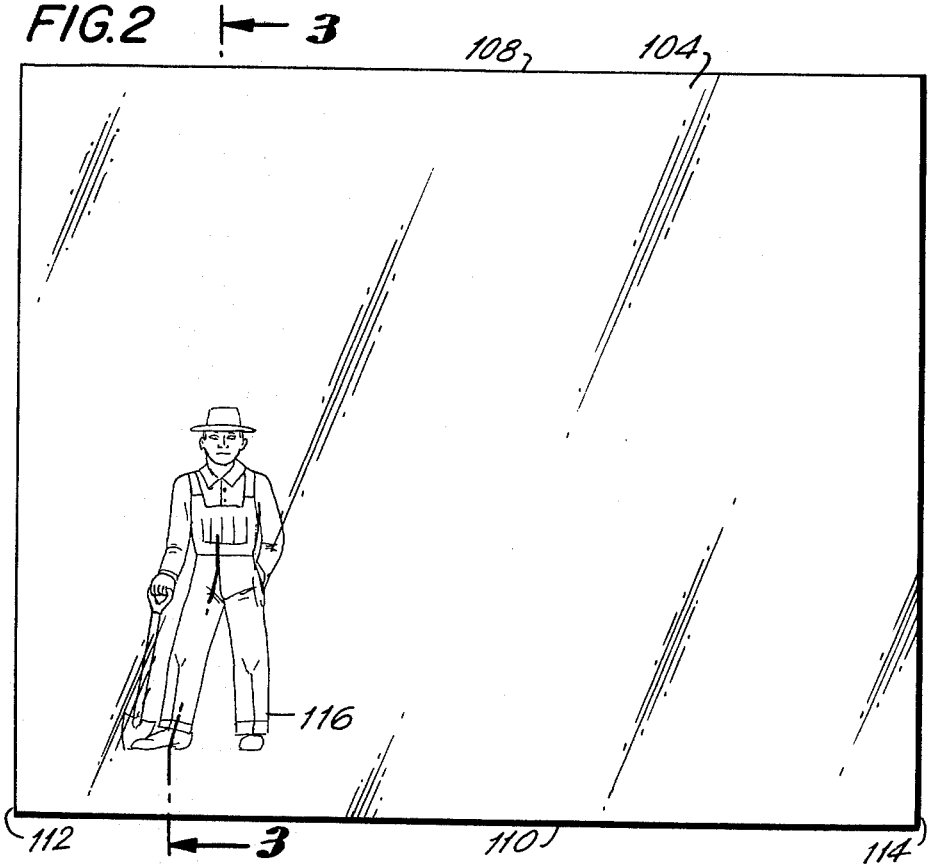
FIG.3
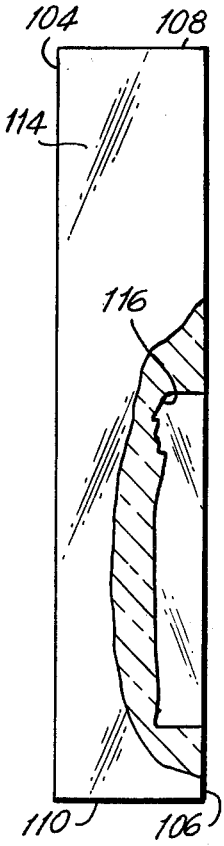

ULTRASONIC PERSPECTIVE CARVING

BACKGROUND OF THE INVENTION

The invention relates to the method and apparatus or system for producing a perspective three dimensional type carving of various sizes in an object utilizing an interrelated set of tools or dies. The products obtained by the present invention exhibit a unique visual effect which may be used on a variety of shaped objects.

The present invention refers to ultrasonic abrasive slurry machining, also known as ultrasonic impact grinding. Ultrasonic slurry machining has been disclosed in U.S. Pat. No. 2,580,716 issued to L. Balamuth dated Jan. 1, 1952, entitled "Method and Means for Removing Material from a Solid Body" and is described also in Ultrasonic Engineering (book) by Julian R. Frederick, John Wiley & Sons, Inc., New York, NY (1966) pages 171 to 183.

The ultrasonic abrasive slurry machining process involves the use of an ultrasonically vibrating tool which is in contact with or slightly spaced from a workpiece. Abrasive particles suspended in a fluid are fed into the gap between the tool and the object or workpiece and are driven with a percussive impact against the workpiece. The high velocity impact of the particles on the workpiece causes an abrading action which is used for producing accurate odd-shaped holds and recesses in hard materials, such as carbides, ceramics, glass, and semi-conductors.

The above process has been used for the carving of glass or crystal to obtain a variety of objects on plates, blocks, ash trays, paper weights, etc. One of the limitations of the above process relates to the diameter of the carving which has been handicapped by the practical limitations of existing vibration transmitting members. The limitations are in the planes perpendicular to the direction of the vibrations to be transmitted. The technical reasons for this are fully explained in U.S. Pat. No. 3,113,225 to Kleesattel et al., of which the present applicant is a co-inventor. With increases in the effective or working dimension of the vibration transmitting member beyond a certain value, the costs of producing a transducer increase disproportionately to become prohibitive.

Although the above Kleesattel et al. patent is applicable to both longitudinal and circular configurations, there are limitations for circular vibration transmitting members. At 20 KHz a tool in excess of approximately 3 inches in diameter presents carving problems as to the flow of abrasive slurry between the tool output surface and the object. Towards this end applicant has found that not withstanding the Klessattel et al. teachings a larger circular tool produced in accordance therewith still presents ultrasonic carving problems. In addition, the power to vibrate a tool of approximately 5–6 inches in diameter exceeds that of generally available conventional instruments.

The prior carving systems due to the inherent limitations of the diameter of the tool as explained above initially led the inventor to attempt to separate a single totality into say two or more carving tools since a single tool could not carve the design in one movement. Upon separating of the carving into individual sections and then carving each one adjacent the other, the inventor found that for most carvings horizontal registration of the tools became a time exacting task that could not be jigged. When the registration on a horizontal plane was not obtained a dividing line was visible in the end product that was not acceptable for commercial sale. Accordingly, the carving of a 5 inch diameter carving with a 20 KHz motor was not practicable with the prior art teachings even if carved in adjacent sections. Applicant found that variations in mounting of the replaceable tools to be ultrasonically vibrated could not be reproduced with an exactness to avoid a visible spacing between the carved sections.

OBJECTS OF THE INVENTION

One object of this invention is the provision of a new and improved method and system for ultrasonic abrasive slurry machining to obtain perspective carvings.

Another object of the invention is the provision of a method and system for increasing the area carved of an interrelated design with ultrasonic abrasive slurry machining.

Another object of this invention is the provision of a method and system employing at least two dies interrelated for machining in partially overlapping relation to each other at different depths to obtain a singular carving void of any discernable machining marks between the carved sections.

Other objects of the invention will become apparent as the disclosure proceeds.

SUMMARY OF THE INVENTION

The present invention permits the creation of a variety of perspective carvings on a host of materials without the inherent problems of the prior art problems. The inventor faced with the problems of horizontal registration or alignment of the individual tools to form the total carving conceived of the idea of separating the carving in a manner that sections or portions thereof are carved by different tools in separate steps and that a portion of each carving after the first overlapped a preceding carving to thereby blend one portion of the total carving into another portion thereby eliminating the horizontal registration parting line.

The inventor also found that a prespective dimension could be added to the total effect when viewed by carving each section to a different depth. Although the invention will be particularly discussed for use in conjunction with a transparent object such as glass or crystal, the invention is adapted for use on various stones or synthetic materials that may be ultrasonically carved. Toward this end one aspect of the invention discloses the carving of a first section to a given depth of say approximately 0.050 inches and thereafter carving a second section with a second tool in partially overlapping relation to said first section and say approximately 0.100 inches. In the area of overlap say from 3 to 50% of the area of the first carving is covered by the second tool. The second tool eliminates the overlapping portion of the first carving and in turn the parting line problem discussed above is eliminated. This produces a single design without any discernable machining marks between the carved sections.

In another embodiment of the invention, the carving procedure is reversed in that the shallow carving is first formed and secondly the deeper carving is formed in partially overlapping relation to the first carving penetrating and eliminating the overlapped portion of the first carving. In this way, when the total carved design or configuration is viewed at the opposite side of the object no parting line is visible and the problem of horizontal registration has been eliminated.

It is appreciated that two or more dies or tools may be used to obtain a single total carving of varying size and depth. In this manner a complete scene, design, etc. may be carved having a multiple number of individual sections yet blended together with no preceptible marks from the tools used.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a front view of an object containing a carved perspective design in accordance with the invention;

FIG. 2 is a view similar to FIG. 1 illustrating the carving of the first section of the perspective design illustrated in FIG. 1;

FIG. 3 is a sectional view taken along line 3—3 of FIG. 2;

DETAILED DESCRIPTION OF THE DRAWINGS

Figure 4:
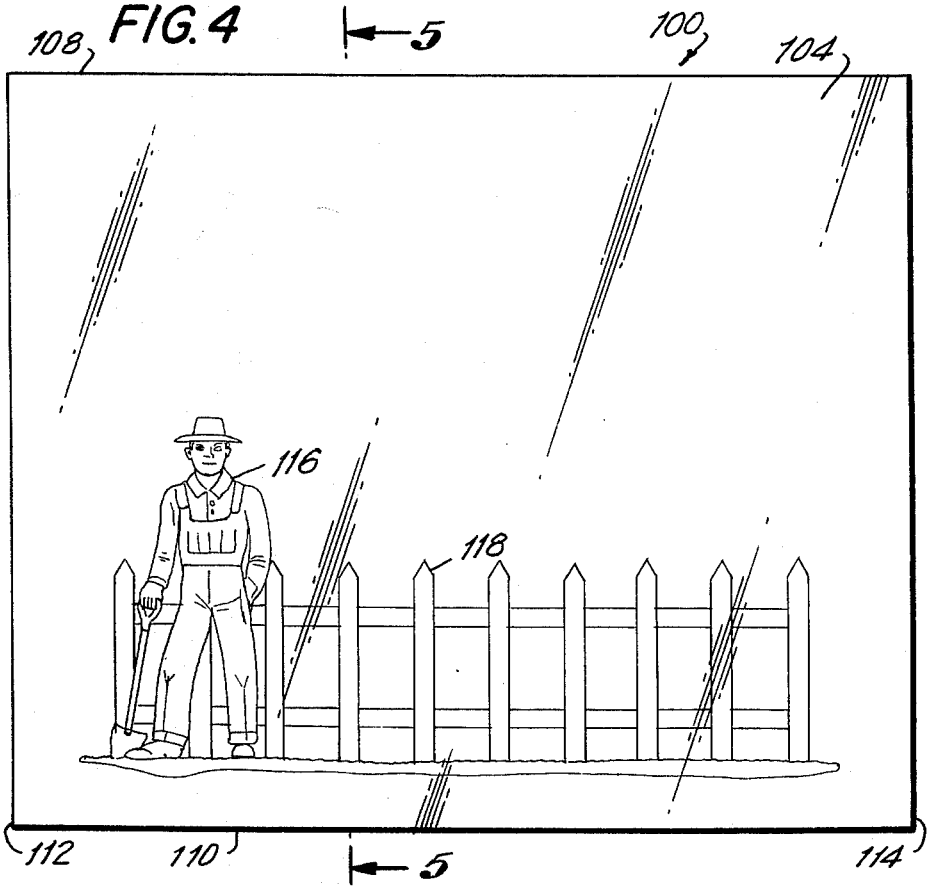
FIG. 4 is a view similar to FIG. 2 illustrating the carving of the second section of the perspective design illustrated in FIG. 1.

Referring now to the figures and FIGS. 1–7 particularly, we have illustrated an object or article of manufacture 100 which may take various forms, shapes, and sizes, from a paper weight or block to a plate, ashtray, etc. The article 100 is novel in that in accordance with the teachings of the present invention a final or total carving of a design or scene 102 is formed that when viewed from the front or viewing surface 104 of the transparent article 100 will be perspective in nature to the eyes of the viewer. The front surface 104 may be flat as illustrated or curved as in a paper weight.

The carving 102 is formed on the rear or carved surface 106 with the upper surface or edge 108 spaced from the lower surface or edge 110 and spaced apart side surfaces or edges 112 and 114 defining the outline of the object which may vary in shape and size. The carving 102 is a single totality illustrated as being comprised of three separate sections, namely a first section or portion 116 carved to a first depth, illustrated in the form of a man; a second section or portion 118, carved to a second depth, illustrated in the form of a fence; and a third section or portion 120 carved to a third depth, illustrated in the form of a tree. Each of the sections being carved to a different depth and configuration. As will be apparent, these particular designs are merely illustrative of the invention and have been selected for purposes of disclosing the invention. The perspective carving 102 is formed of at least two sections or portions that when viewed in its totality provide the viewer with a perception of depth not heretofore obtainable.

Figure 5:
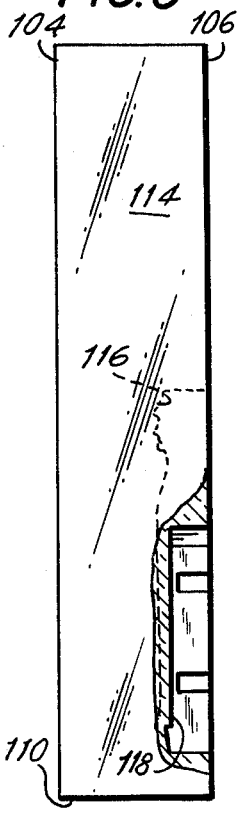
FIG. 5 is a sectional view taken along line 5—5 of FIG. 4.

FIG. 1 illustrates the finished product and as seen in FIG. 2 the initial or first carved section 116 is machined to a depth of say approximately 0.100 inches as illustrated in FIG. 3 from the surface 106. The carving 116 is formed from a first tool as hereinafter explained in detail that may be carved to a depth in the range of 0.050 to 0.250 inches. Hereinafter, a second carved section 118, in the form of a fence, is formed on the surface 106 which as illustrated in FIGS. 4 and 5, is to a depth lesser than the first section to approximately 0.060 inches. The depth of the second carving may be in the range of 0.010 to 0.200 inches.

The separate carving of sections 116 and 118 avoids the horizontal alignment problem of registration of starting one tool where a prior tool finished. Another feature is that by first carving the deeper section 116, the fence 118 is then carved behind it. In the area of overlap between the fence 118 and the first carving 116 which is deeper, the material removed will not be carved again. Accordingly, no registration or alignment of extreme accuracy must be relied upon. Further, although a tool the size of the fence 118 or man 116 is feasable, individually a tool of the size incorporating both is impracticable for the reasons set forth above with respect to the area of the tool generally expressed in terms of its diameter. For approximately a 20 KHz ultrasonic motor a 3 inch diameter tool is feasible. Therefore, although the fence 118 or man 116 each can be placed on an individual 3 inch diameter tool, a combined tool for both would require say a 5 inch diameter tool which is impracticable at 20 KHz.

Figure 6:
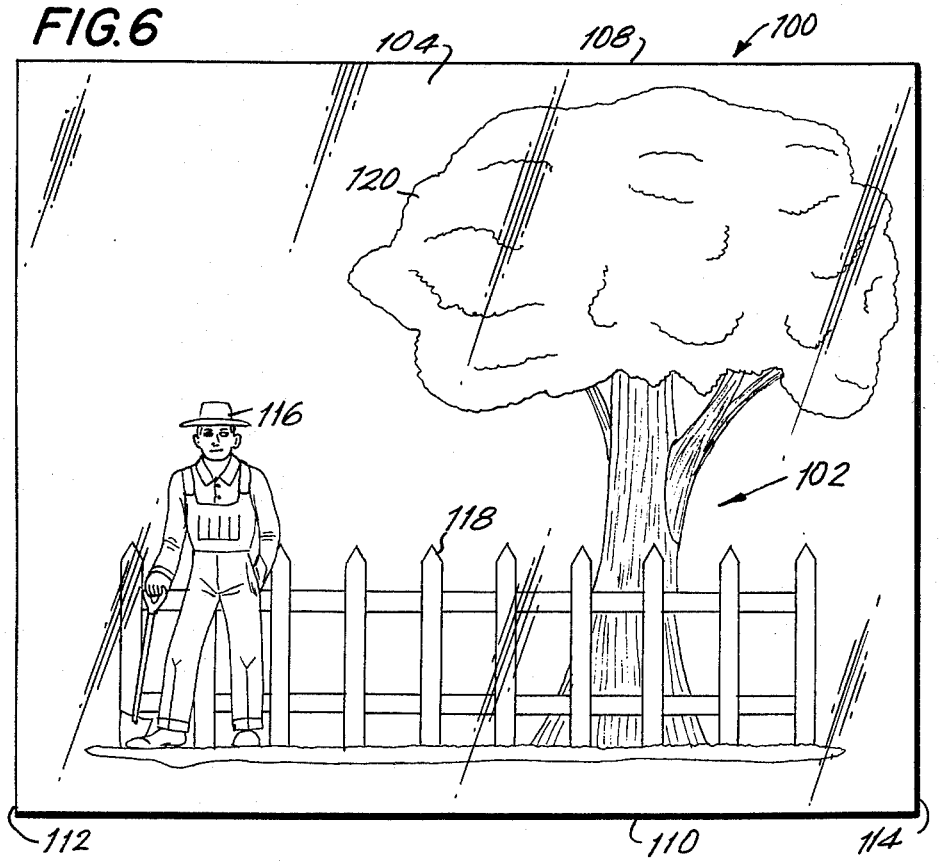
FIG. 6 is a view similar to FIG. 4 illustrating the carving of the third section of the perspective design illustrated in FIG. 1.
Figure 7:
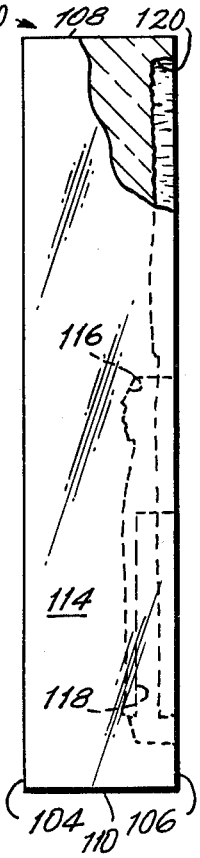
FIG. 7 is a side elevational view of the object in FIG. 6 partly in section.

FIGS. 6 and 7 illustrate the third carved section 120 in form of a tree which is carved on rear surface 106 and is of a depth of approximately 0.030 inches. The shallowness is such that in perspective the tree 120 stands behind the fence 118. Once again the registration or alignment problems have been eliminated in that the tree 120 will not be carved in those areas that the fence 118 exists.

Accordingly a complete perspective carving may be on a block say 5 inches by 5 inches, or smaller, or even 1 or 2 feet square and consisting of a dozen carvings some of which or all of which overlap a portion of another carving.

Each carving may vary in depth but in the area of overlap there has to be a difference to avoid the registration problem. In this manner the deepest carving extends perspectively in front of the other carving when the completed carving is formed. For example, although the second carving of fence 118 is of an average depth of 0.060 inches it may be deeper as it extends from the first carving 116 to obtain further perspective effects.

Figure 8:
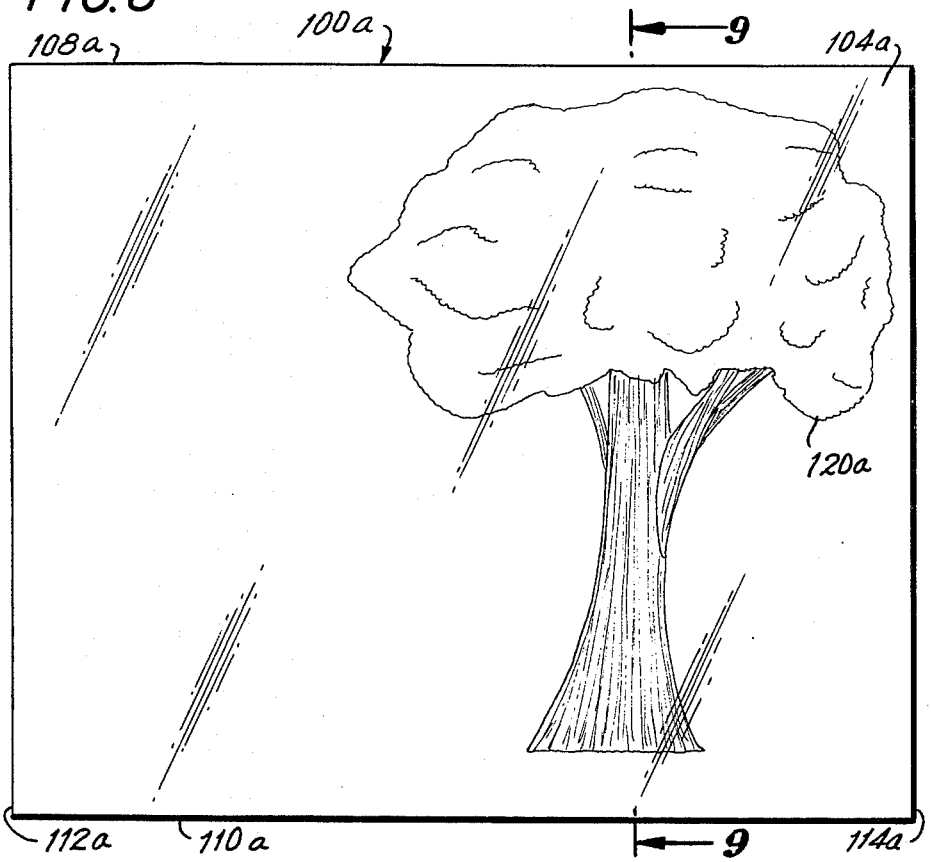
FIG. 8 is a front view of an object in which the third section illustrated in FIG. 1 is carved first.
Figure 9:
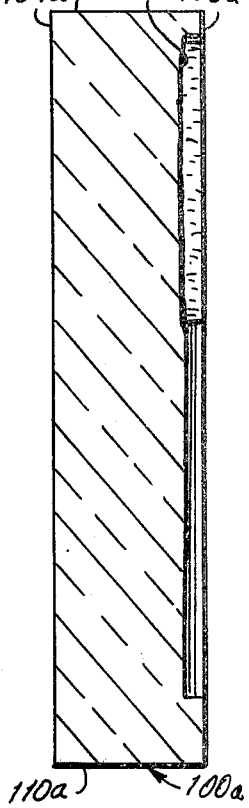
FIG. 9 is a sectional view taken along line 9—9 of FIG. 8.
Figure 10:
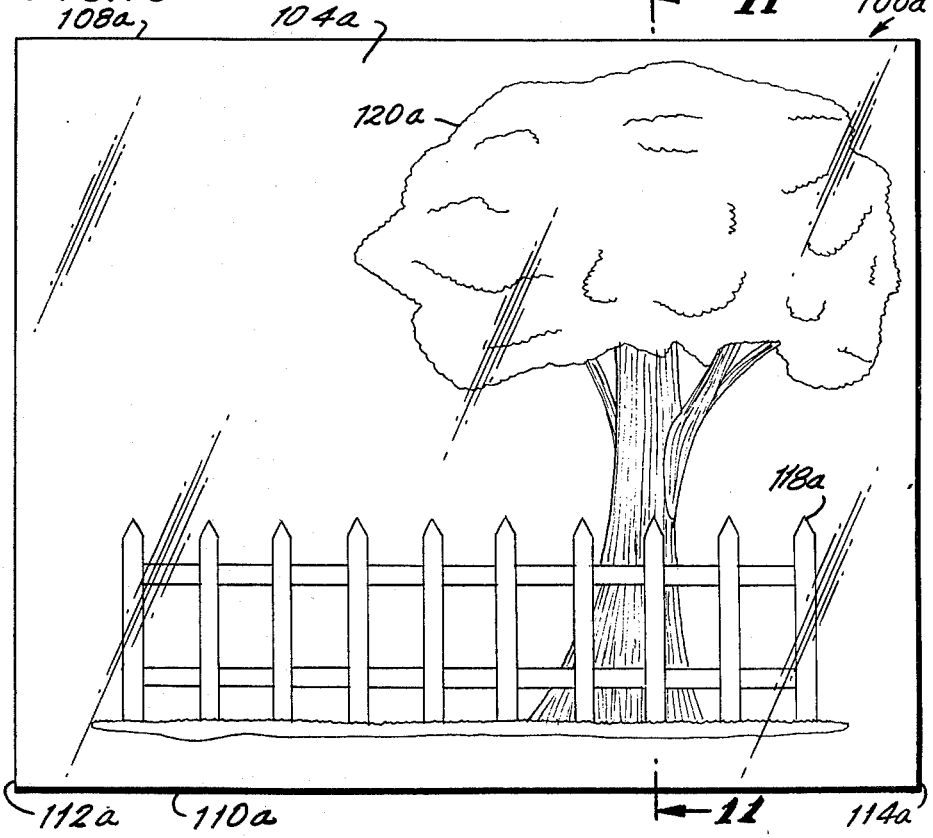
FIG. 10 is a view similar to FIG. 8 illustrating the carving of the second section illustrated in FIG. 1.
Figure 11:
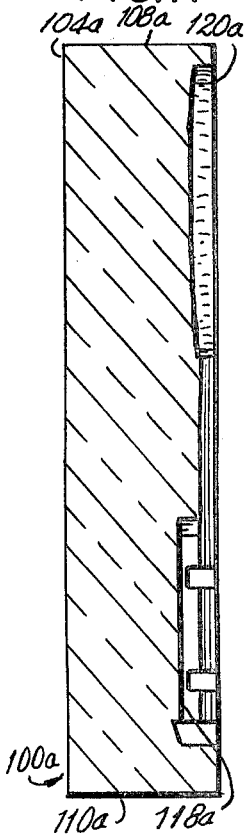
FIG. 11 is a sectional view taken along line 10—10 of FIG. 10.
Figure 12:
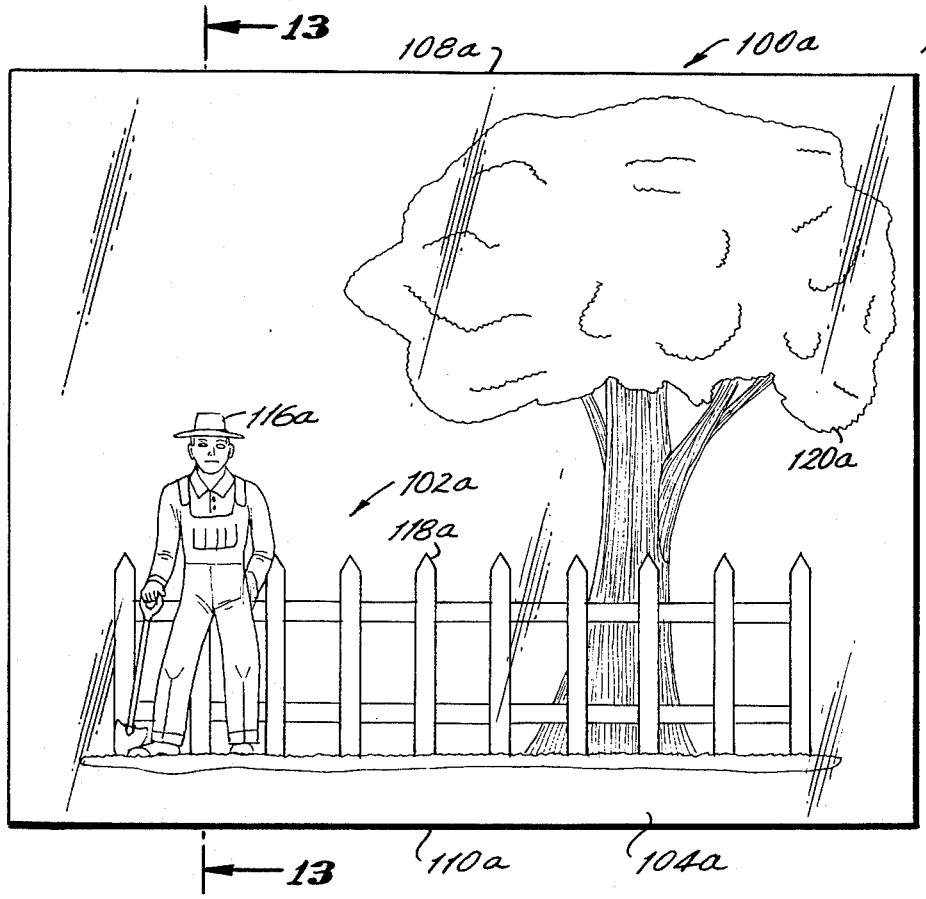
FIG. 12 is a view similar to FIG. 1 showing the perspective carving after the carving of the first section.
Figure 13:
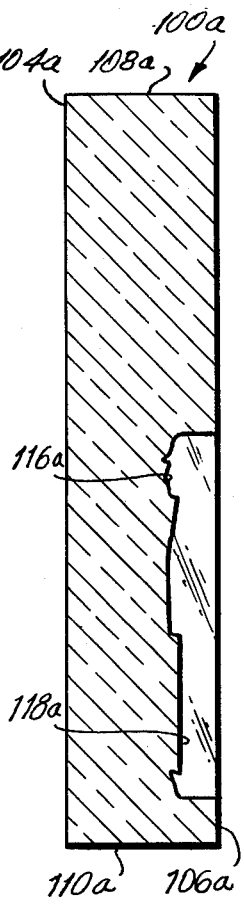
FIG. 13 is a sectional view taken along line 12—12 of FIG. 12.

The above process of carving inter-related sections as illustrated in FIGS. 1–7 may be carved in reverse with the elimination of the registration and other problems set forth above. FIGS. 8–11 illustrates the process in which the shallow section of the carving is first formed to obtain in the work object 100*a* a complete design 102*a.* As illustrated in FIGS. 8 and 9, the third section 120*a* may first be carved to say 0.030 inches on the surface 106*a,* then the second section 118*a* of the fence is carved as illustrated in FIGS. 10 and 11 to a depth of approximately 0.060 inches. In this manner the fence 118*a* obliterates the overlapping portions of the tree 120*a* so that when viewed from surface 104*a* the fence 118*a* in in front of the tree 120*a.* When the man 116*a* is carved as illustrated in FIGS. 10 and 11 to the depth of approximately 0.100 inches which extends through the fence 118*a* in the area of overlap. Accordingly, the article 100*a* may be manufactured by sequentially carving from the deep to shallow sections or in reverse from the shallow to deeper sections.

The sections may each overlap each other a minimal amount so that an entire scene of a variety of objects or portions of a building, etc., may be formed to create a composite picture in say crystal or other medium capable of ultrasonic machining. The area of overlap may be from approximately 3 to 50% of the area of each section of the total design. Although the object has been illustrated in that the viewing surface is in spaced relation to the carving surface, the present invention also includes intaglio engraving such that a raised surface is obtained.

FIGS. 14–19 illustrate the invention with the object or article 100*b* in the form of a transparent plate with a viewing surface 104*b* and rear surface 106*b* having carved therein the design 102*b* in the form of a tree composed of three sections 116*b* for the trunk, 118*b* for the left side, and 120*b* for the right side. By carving the three sections at different depths the perspective carving is obtained. Particularly by having an area of overlap between sections horizontal registration is not critical.

Figure 14A:
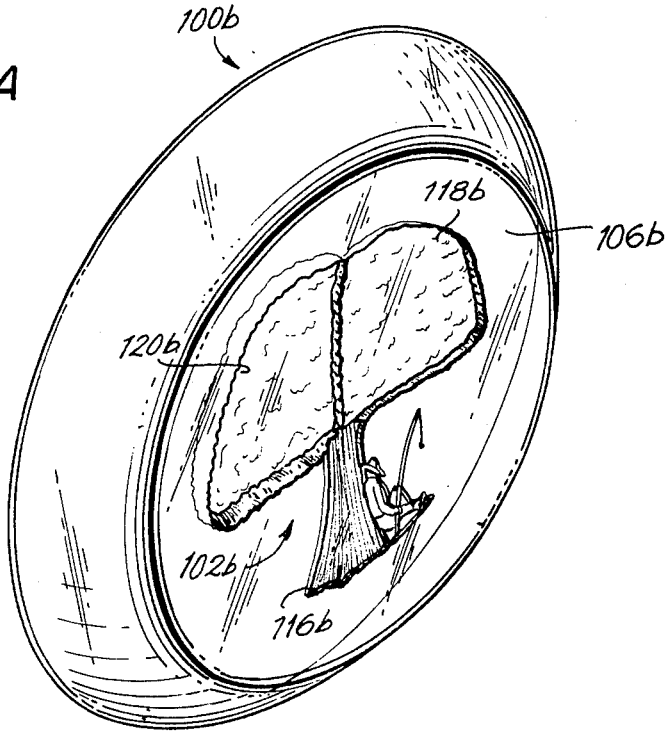
FIG. 14A is a view of the object illustrating the carved surface thereon.
Figure 14:
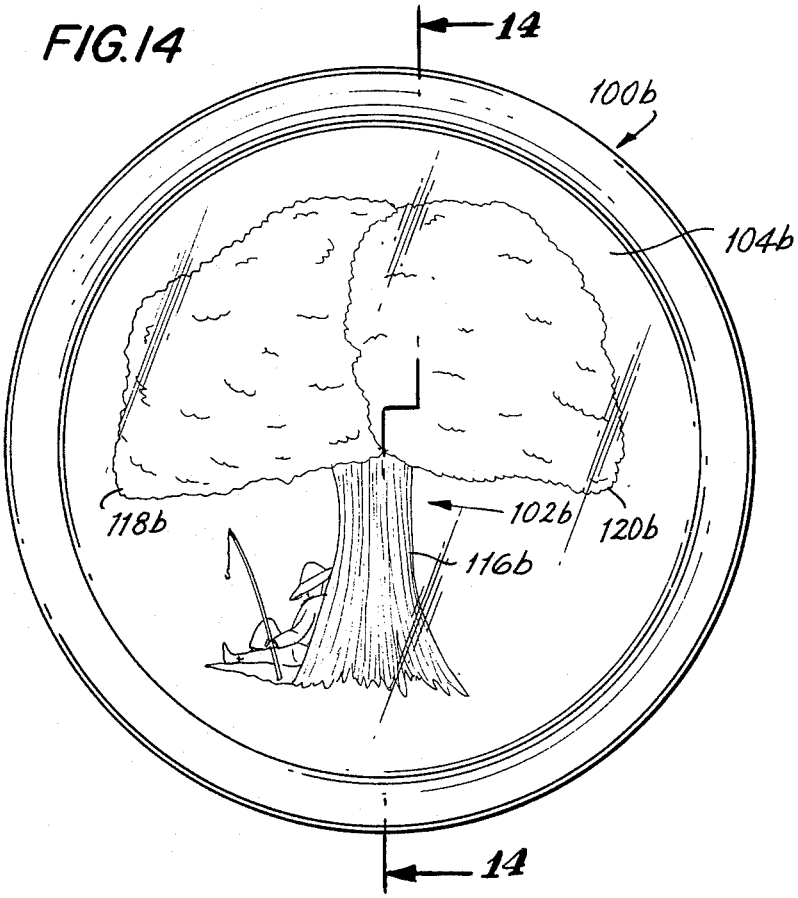
FIG. 14 is a front view of a plate containing a carved perspective design in accordance with the invention.
Figure 15:
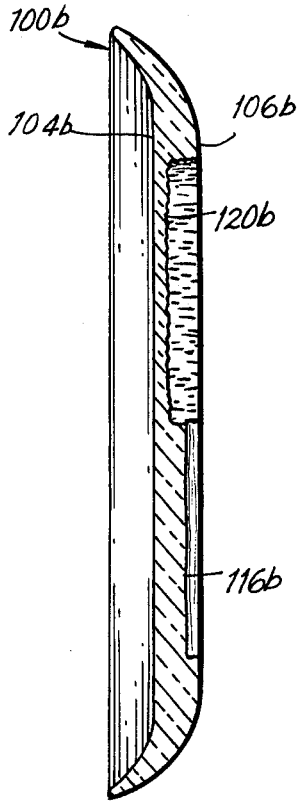
FIG. 15 is a sectional view taken along line 15—15 of FIG. 14.
Figure 16:
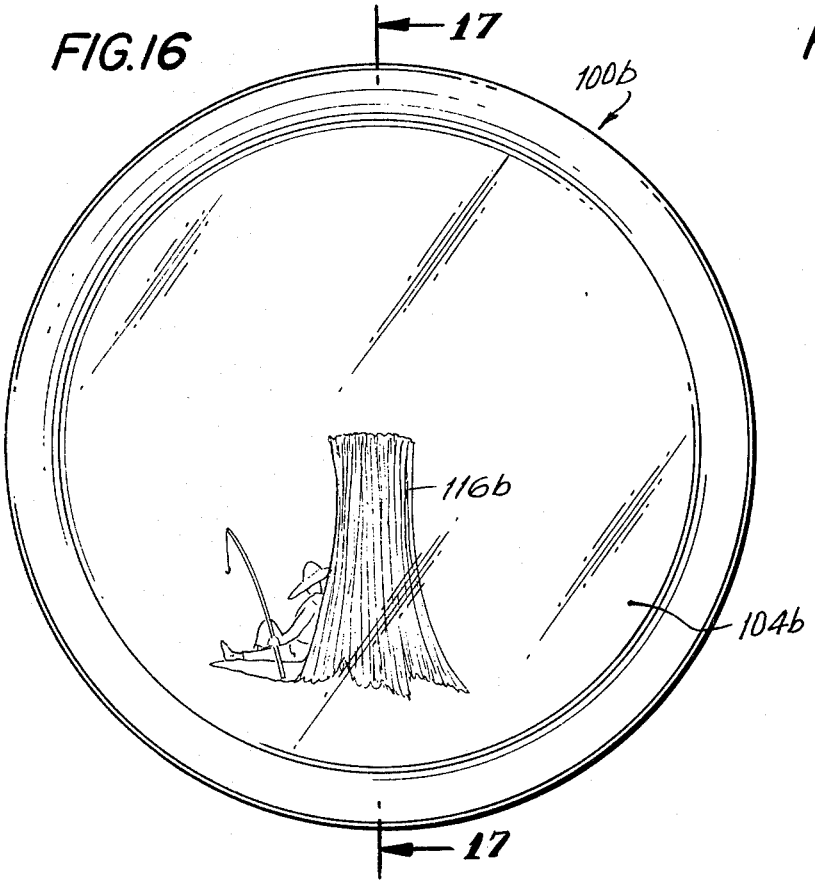
FIG. 16 is a view similar to FIG. 14 illustrating the carving of the first section of the perspective design illustrated in FIG. 14.
Figure 17:
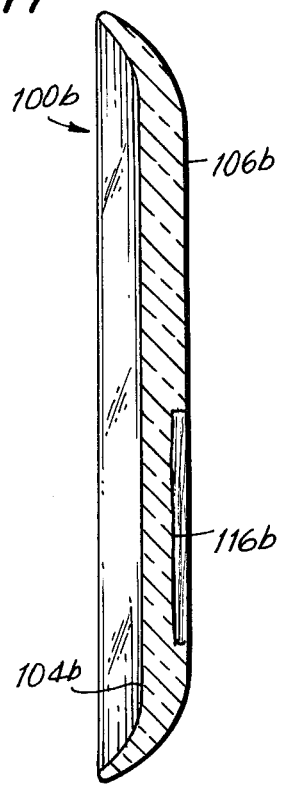
FIG. 17 is a sectional view taken along line 17—17 of FIG. 16.
Figure 18:
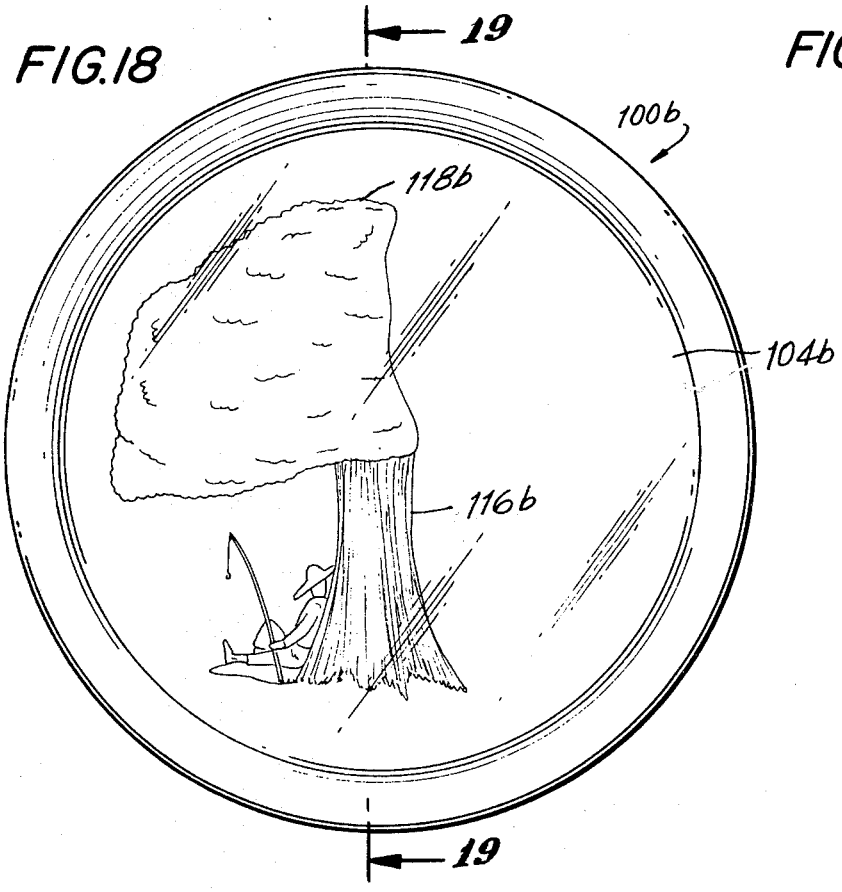
FIG. 18 is a view similar to FIG. 16 illustrating the carving of the second section of the perspective design illustrated in FIG. 14.
Figure 19:
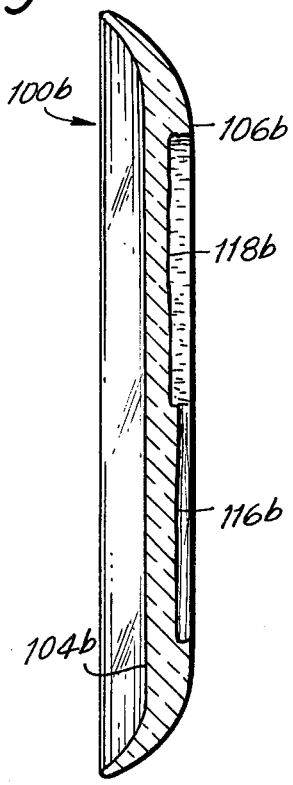
FIG. 19 is a sectional view taken along line 19—19 of FIG. 18.

FIGS. 14 and 15 illustrate the final product. FIG. 14A illustrates the rear surface 106*b* to obtain the depth perception and the blending of the three sections illustrated to obtain the design 102*b* of a single totality. FIGS. 16 and 17 illustrate the tree trunk 116*b* being carved first and to the shallowest depth so that it is farthest from the viewer seeing the design 102*b* through the surface 104*b.* FIGS. 18 and 19 illustrate the section 118*b* carved into the surface 106*b* and to a greater depth. FIG. 14 illustrates the object 100*b* when the last section 120*b* is carved therein to an even greater depth. Each carved section removes the overlapped portion and the three sections each overlap each other to blend the sections together. If desired the process could be reversed with the carving of section 120*b* then 118*b* and finally 116*b* to obtain the same end result.

By utilizing a plurality of tool sections, the circular area encompassing the perspective carving is in a range of approximately 2 to 12 inches. Accordingly the fact that one tool overlaps another, and each has a contoured configuration adapted to blend with each other projects a single totality of design to the viewer. If desired, the depth of each section may be substantially the same in order to increase the size of the design. Each section may form an integral part of the total design as illustrated with respect to the fence, tree, and man. If desired, each section blends with each other to project the single totality, as exemplified by the tree trunk, and branches.

Figure 20:
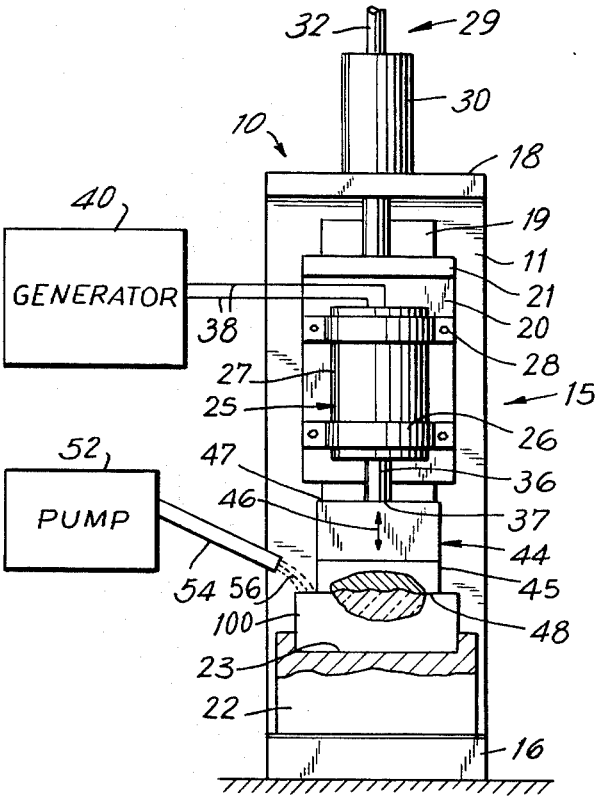
FIG. 20 is a front view of ultrasonic carving apparatus according to the invention.
Figure 21:
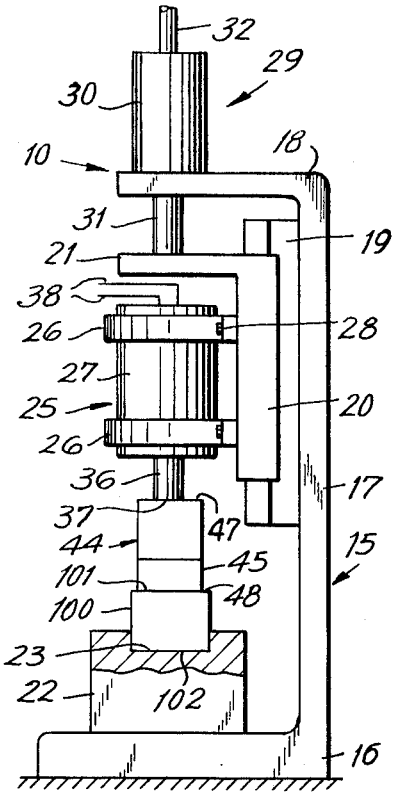
FIG. 21 is a side view, partly in section, of the ultrasonic carving apparatus of FIG. 1.

Referring to FIGS. 20 and 21, therefore, there is illustrated apparatus 10 for ultrasonically carving the object, article or work member 100. As indicated by the crosshatching in FIG. 21, the work member 100 is of a glass material, but it will be realized that rigid bodies or sheets of materials such as crystal, metal, gems, stones, etc., may be machined in accordance with the present invention. However, for the purpose of the explanation of the figures to follow, it will be assumed that the apparatus is working with glass materials.

The basic structure for carving materials as well understood by those skilled in the art, comprises a vibrator support assembly in the form of a support stand 15 that is provided for maintaining the vibrator assembly 25 in proper position, and may include a base 16 with an upright wall 17 extending upwardly from one end of said base and a head 18 extending from the upright wall 17 and in overlapping relationship to the base 16. Mounted on the upright wall 17 is a mounting channel 19 which engages a support block 20 which is slidably connected by a dovetail connection (not shown) to the mounting member 19 to permit vertical movement of the vibrator assembly 25 between the base 16 and head 18 of the support stand 15. The vibrator assembly 25 is suitably secured to the support block 20, for example, by means of bands 26 which encompass the casing 27 of the vibrator assembly and are secured to the support block 20 by means of bolts 28. A support member or mounting fixture 22 of any suitable type for holding the work member 100 is provided on the base 16 and has a recess 23 therein for receiving the work member.

Drive means 29 to effect vertical movement of the vibrator assembly 25 toward and away from the support member 22 is provided and may be in the form of a cylinder 30 vertically mounted to the head 18 and having a shaft 31 extending therefrom and through the head 18 and coupled to a horizontal flange 21 of the support block 20 in any conventional manner. The air cylinder 30 may be operated by supplying compressed air conveyed by a conduit 32 from an exterior source (not shown) and extended from the rear of the cylinder. The exact height of adjustment is generally determined prior to the commencement of the carving cycle and will determine the depth of the textured or carved surface.

The mechanical vibrator assembly 25 includes a transducer (not shown) which may be any one of a number of electromechanical types, such as, electrodynamic, piezoelectric or magnetostrictive. The operating frequency may be in the sonic or ultrasonic range between approximately 1 to 100 KHz, but preferably in the range from 10 to 30 KHz. The vibrator assembly 25 is of the type generally disclosed in the art. The transducer 35 housed within the casing 27 may be cooled as by water or air.

The vibrator assembly, 25, generally includes a driver unit made up of a transducer secured to an acoustic impedance transformer or connecting member 36 that extends from the casing 27. The transducer of mechanical vibrations may comprise a stack of laminations of magnetostrictive material, for example, nickle, and surrounded by a coil winding (not shown) adapted to carry a biased, high-frequency alternating energizing current. The lower ends of the laminations making up the stack of the transducer are fixedly secured, as by welding or soldering, to the upper end of the transformer 36. The transformer 36 has an enlarged section (not shown) in the general area of a nodal plane of motion, and this section constitutes a flange secured to the casing 27.

A biased, high-frequency alternating current is supplied to the winding through conductors 38 extending from a suitable oscillation generator 40, well known in the art. An oscillation generator is effective to supply a biased alternating current to the winding at a resonant frequency of the driver unit of transducer and is further effective to vary the frequency of the supplied biased, alternating current when the resonant frequency of the driver unit is varied due to changes in temperature, or changes in the loading thereof. The frequency of the supplied biased alternating current is adjusted in the oscillation generator in response to a feedback signal from a capacitor-type pickup connected in the transducer; it is to be understood that other types of pickups may be employed. Oscillation generators may be employed, in which adjustment of the frequency of the alternating current supplied by the oscillation generator is obtained through the use of a feedback signal which varies with the impedance of the transducer.

The lower output end 37 of transformer 36 is coupled to the input end 47 of tool member 44 with a replaceable tool member 45 so that when the vibrator assembly 25 is operated, by electrical oscillations supplied from generator 40, compressional waves are generated in the vibrator 25, the transformer 36, member 44, and tool 45, so as to cause vibrational movements in the vertical direction, that is along the longitudinal axis of the transducer. For the purposes of the present invention, such vibrations preferably have a frequency in the range between approximately 1,000 cycles per second and 100,000 cycles per second, and are of sizable amplitude, for example, in the range between approximately 0.0001 and 0.01 inch. In order to ensure that the maximum amplitude of vibration in the vertical direction is obtained at the lower end or textured tool surface 48 of the tool member 45, as indicated by the double headed arrow 46, thus ensuring the maximum transmission of working acoustical energy, the overall length of the motor, the transformer 36, tool 44, and the tool member 45 is selected so that, at the frequency of the electrical oscillations a loop of longitudinal motion of the generated compressional waves occurs at or near the tool surface 48 of the tool member 45.

The tool member 45 as seen in FIGS. 20 and 21 is of a metallic material having good acoustical transmission properties so that the vibrations transmitted from the input surface 47 are propogated through the member to its output tool surface 48. The coupling between the output end 37 of the vibrator assembly 25 and the tool 44 may be of any conventional form for example as by a threaded coupling (not shown).

Figure 22:
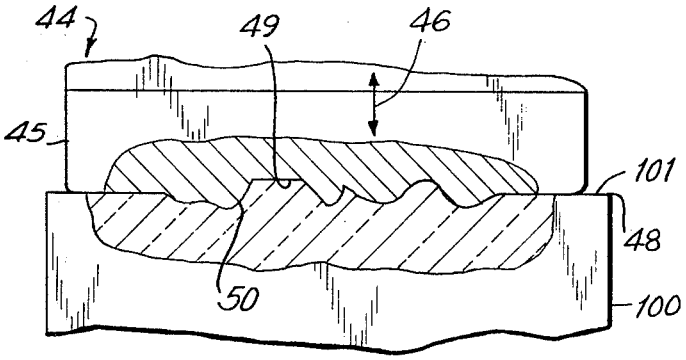
FIG. 22 shows, at enlarged scale, the relationship of the tool to the work object of FIG. 1, during the carving operation.

The output surface 48 of the tool member 45 may have any number of desired configurations so that a replica of the tool surface is carved on the work member 100 which is generally of a hard material. As seen in FIG. 22, which is an enlarged view showing the interfacial contact area between the tool member 44 and the work member 100 to more clearly illustrate the carving, the output surface 48 has a textured surface which consists of a series of valleys 49 and peaks or hills 50 that when blended together with various radii, form a desired surface configuration which is to be reproduced in the object 100. The pump means 52 through a tubing 54 directs an abrasive slurry 56 toward the interface between tool surface 48 and workpiece 100.

It will be apparent that the front end 45 of the tool 44 is a replaceable member firmly secured as by brazing or soldering. The replaceable tool or member 45 may be cast, etched, stamped, or manufactured in a conventional way known in the art with the workpiece 100 carved to the desired configuration.

Figure 23:
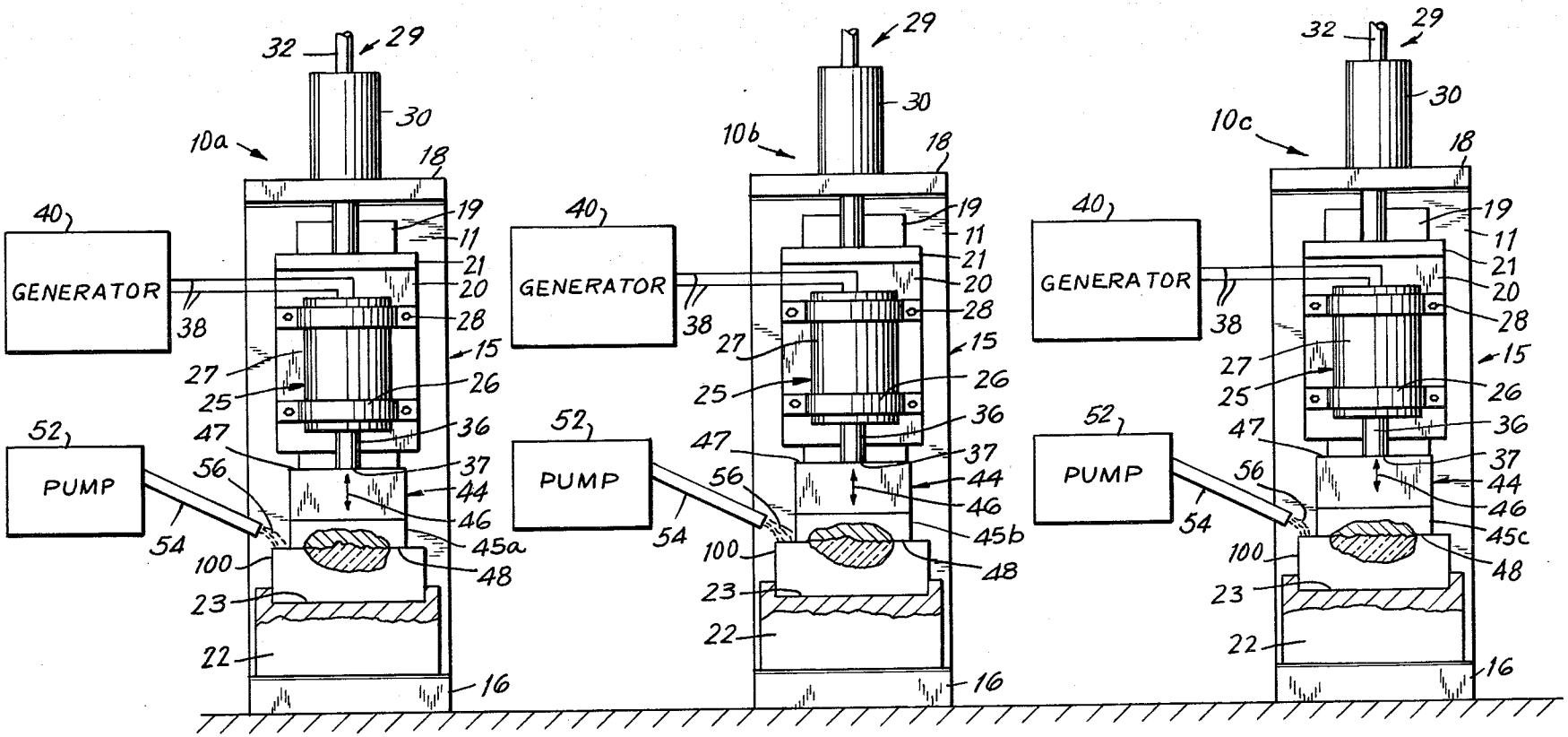
FIG. 23 is a front view of a carving system to produce a perspective carving.

The system for carving the object 100 may be done on a production basis in that rather than change the tool a series of machines may be used, one for each section to be carved. FIG. 23 illustrates the system in which machine **10*b* has tool 45*b* for carving the first section 116 as illustrated in FIG. 1. The second machine 10*c* has tool 45*c* associated therewith for carving the second section 118 and machine 10*d* has tool 45*d* for carving the third section 120*d***. The inter-relation of the carving system is that each tool is designed to extend in overlapping relationship with a portion of the previously used carving tool. Obviously as explained above, the carvings may be from deep to shallow or in reverse with the same end result.

In addition the carving system will include means for collecting the spent abrasive slurry and recirculating same in a manner well known in the art.

The replaceable tool member that is brazed to the tool may last from five to fifteen deep carvings before replacement is required. The alignment difficulty of the prior art as discussed above results in part due to the need for changing of the tool and the inability to perform a carving without discernable machining marks between the sections. In the manner described by positioning each tool adjacent the object and urging contact between the tool and the object as an abrasive slurry is supplied abrading machining of the object is obtained while the tool is ultrasonically vibrated. By overlapping each tool an endless design can be created, in a manner not previously known.

CONCLUSION

Accordingly, applicant has invented and disclosed herein a new and novel process and system that may be used commercially for the carving of various objects to obtain a perspective carving of various sizes. Although artistic designs have been illustrated, it is appreciated that a variety of uses and applications may be utilized that are within the scope of the invention.

Many other changes could be effected in the particular constructions, and in the methods of use and construction, and in specific details thereof, hereinbefore set forth, without substantially departing from the invention intended to be defined herein, the specific description being merely of preferred embodiments capable of illustrating certain principles of the invention.

Accordingly, although illustrative embodiments of the invention have been described in detail herein with reference to the accompanying drawings, it is to be understood that the invention is not limited to those precise embodiments, and that various changes and modifications in addition to those mentioned above may be effected therein by one skilled in the art without departing from the scope or spirit of the invention, except as defined in the appended claims.

I claim:

1. The method of carving a design in an object with ultrasonic energy comprising:

A. providing cooperating tools each having a different working surface configuration for carving sections of the design on a surface of the object in partially overlapping relation to each other, B. carving a first section of the design with one of said tools utilizing ultrasonic energy to a first depth, and C. carving a second section of the design in partially overlapping relation to the first section with the other of said tools utilizing ultrasonic energy to a second depth different from said first depth, whereby the combined first and second carved sections creates a design of a single totality in perspective on the object.

2. The method as defined in claim 1, and further including the step of carving the second section to a depth greater than the first section to carve through and remove the overlapping portion therebetween, whereby horizontal registration between the sections is not critical.

3. The method as defined in claim 1, and further including the step of carving the second section to a lesser depth and in partially overlapping relation to said first section, whereby horizontal registration between the sections is not critical.

4. The method as defined in claim 1, and further including the step of carving one of said tools to a depth in a range of approximately 0.010 to 0.200 inches.

5. The method as defined in claim 4, and further including the step of carving the other of said tools to a depth in a range of approximately 0.050 to 0.250 inches.

6. The method as defined in claim 1, and further including the steps of:

a. providing another cooperating tool having a different configuration at the working surface than said prior cooperating tools, and b. carving a third section with the last said provided cooperating tool employing ultrasonic energy in overlapping relationship to one of said prior carvings and to a different depth into the object, whereby the deepest carving extends perspectively in front of the other carvings as the design in the object is viewed.

7. The method claimed in claim 1, and further including the steps of:

a. providing additional tools each having a different configuration at the working surface thereof, and b. sequentially carving additional sections in the object with said tools.

8. The method as defined in claim 1, and wherein each of said steps of carving further includes the steps of:

a. supporting the object, b. positioning each tool adjacent the object, c. urging contact between the tool and the object, d. supplying an abrasive slurry between the tool and object to cause abrading machining of the object by the tool, and e. vibrating the tool ultrasonically while the tool is urged into contact with the object.

9. The method as defined in claim 8, and further including the step of ultrasonically vibrating the tool in a frequency range of approximately 10 to 1,000 KHz.

10. The method as defined in claim 1, wherein the object is crystal.

11. The method as defined in claim 1, wherein the object is glass.

12. The method as defined in claim 1, wherein the object is in the form of a plate.

13. The method as defined in claim 1, wherein the circular area encompassing the perspective carving is in the range of approximately 2 to 12 inches.

14. The method as defined in claim 1, a. wherein the object is of a transparent material, b. wherein the design is carved on one surface of the object, and c. wherein the design is viewed through a spaced apart surface of the object.

15. The method as defined in claim 1, wherein said carving steps are carried out on the same carving machine and without repositioning the object.

16. The method as defined in claim 1, wherein said carving steps are carried out on different machines and the object is repositioned for each machine.

17. The method as defined in claim 1, wherein each of said sections carved is a definable entity in and to itself.

18. The method as defined in claim 1, wherein each of said sections carved forms an integral part of the design totality.

19. The method as defined in claim 1, wherein the tools each have a contoured configuration adapted to blend with each other in a manner to project a single totality of design to the viewer.

20. The method of ultrasonically carving a perspective design in a transparent object, comprising the steps of:

A. carving a first section ultrasonically on a surface thereof to a first depth within the object, and B. carving a second section ultrasonically within the object in partially overlapping relation to the first section and to a second depth greater than the first depth to remove that portion of the first carving within the overlapped carved areas, whereby the combined first and second carved sections create a design of a single totality with the second carving extending perspectively in front of the first carving as viewed through a spaced apart surface of the object.

21. The method as defined in claim 20, and further including the step of carving the first section to a depth in a range of approximately 0.010 to 0.200 inches.

22. The method as defined in claim 21, and further including the step of carving the second section to a depth in a range of approximately 0.050 to 0.250 inches.

23. The method as defined in claim 20, and further including the step of carving a third section ultrasonically into the object in partially overlapping relationship to one of the other sections and to a different depth, whereby the deepest carving extends perspectively in front of the other carvings as the design in the object is viewed.

24. The method claimed in claim 20, and further including the step of sequentially carving additional sections in the object in partially overlapping relation to at least one other section.

25. The method as defined in claim 20, and wherein said step of carving further includes the steps of:

a. providing a tool having a working surface to form the configuration of the carved section,
b. supporting the object,
c. positioning the tool adjacent the object,
d. urging contact between the tool and the object,
e. supplying an abrasive slurry between the tool and object to cause abrading machining of the object by the tool, and
f. vibrating the tool ultrasonically while the tool is urged into contact with the object.

26. The method as defined in claim 25, and further including the step of ultrasonically vibrating the tool in a frequency range of approximately 10 to 1,000 KHz.

27. The method as defined in claim 20, wherein the object is crystal.

28. The method as defined in claim 20, wherein the object is glass.

29. The method as defined in claim 20, wherein the object is in the form of a plate.

30. The method as defined in claim 20, wherein the circular area encompassing the perspective carving is in the range of approximately 2 to 12 inches.

31. The method of ultrasonically carving a perspective design in a transparent object comprising the steps of:

A. carving a first section ultrasonically on a surface thereof to a first depth within the object, and
B. carving a second section ultrasonically within the object in partially overlapping relation to the first section and to a second depth less than the first depth to blend the first carving with the second carving within the overlapped carved areas, whereby accurate horizontal registration between the carvings is avoided and the combined first and second carved sections create a design of a single totality with the first carving extending perspectively in front of the second carving as viewed through a spaced apart surface of the object.

32. The method as defined in claim 31, and further including the step of carving the first section to a depth in a range of approximately 0.050 to 0.250 inches.

33. The method as defined in claim 32, and further including the step of carving the second section to a depth in a range of approximately 0.010 to 0.200 inches.

34. The method as defined in claim 31, and further including the step of carving a third section ultrasonically into the object in partially overlapping relationship to one of the other sections and to a different depth, whereby the deepest carving extends perspectively in front of the other carvings as the design in the object is viewed.

35. The method claimed in claim 31, and further including the step of sequentially carving additional sections in the object in partially overlapping relation to at least one other section.

36. The method as defined in claim 31, and wherein said step of carving further includes the steps of:

a. providing a tool having a working surface to form the configuration of the carved section,
b. supporting the object,
c. positioning the tool adjacent the object,
d. urging contact between the tool and the object,
e. supplying an abrasive slurry between the tool and object to cause abrading machining of the object by the tool, and
f. vibrating the tool ultrasonically while the tool is urged into contact with the object.

37. The method as defined in claim 36, and further including the step of ultrasonically vibrating the tool in a frequency range of approximately 10 to 1,000 KHz.

38. The method as defined in claim 31, wherein the object is crystal.

39. The method as defined in claim 31, wherein the object is glass.

40. The method as defined in claim 31, wherein the object is in the form of a plate.

41. The method as defined in claim 31, wherein the circular area encompassing the perspective carving is in the range of approximately 2 to 12 inches.

42. The method of carving a design in an object with ultrasonic energy comprising the steps of:

A. providing cooperating tools each having a different working surface configuration for carving sections of the design on a surface of the object in partially overlapping relation to each other,
B. carving a first section and a second section respectively with said tools utilizing ultrasonic energy in partially overlapping relation to each other, each of said sections adapted to blend with each other, whereby the combined first and second carved sections create a design of a single totality on the object, said step of carving said design further including the steps of:
C. supporting the object,
D. positioning each tool adjacent the object,
E. urging contact between the tool and the object,
F. supplying an abrasive slurry between the tool and object to cause abrading machining of the object by the tool, and
G. vibrating the tool ultrasonically while the tool is urged into contact with the object.

43. The method as defined in claim 42, and further including the step of carving the second section to a depth greater than the first section to carve through and remove the overlapping portion therebetween, whereby horizontal registration between the sections is not critical.

44. The method as defined in claim 42, and further including the step of carving the second section to a lesser depth and in partially overlapping relation to said first section, whereby horizontal registration between the sections is not critical.

45. The method as defined in claim 42, and further including the step of carving one of said tools to a depth in a range of approximately 0.010 to 0.200 inches.

46. The method as defined in claim 45, and further including the step of carving the other of said tools to a depth in a range of approximately 0.050 to 0.250 inches.

47. The method claimed in claim 42, and further including the steps of:

a. providing additional tools each having a different configuration at the working surface thereof, and
b. sequentially carving additional sections in the object with said tools.

48. The method as defined in claim 42, wherein said steps of carving is carried out on the same carving machine and without repositioning the object.

49. The method as defined in claim 42, wherein said steps of carving is carried out on different machines and the object is repositioned for each machine.

* * * * *